US008393781B2

(12) United States Patent
Manera et al.

(10) Patent No.: US 8,393,781 B2
(45) Date of Patent: Mar. 12, 2013

(54) INCUBATING ORBITAL SHAKER

(75) Inventors: Michael D. Manera, Clayton, NJ (US); Martin P. Yankowy, Broomall, PA (US); Michael Elefante, Williamstown, NJ (US); H. William Busch, Jr., Wilmington, DE (US)

(73) Assignee: Henry Troemner LLC, Thorofare, NJ (US)

( * ) Notice: Subject to any disclaimer, the term of this patent is extended or adjusted under 35 U.S.C. 154(b) by 1304 days.

(21) Appl. No.: 11/851,046

(22) Filed: Sep. 6, 2007

(65) Prior Publication Data

US 2008/0056059 A1 Mar. 6, 2008

Related U.S. Application Data

(60) Provisional application No. 60/842,698, filed on Sep. 6, 2006.

(51) Int. Cl.
*B01F 11/00* (2006.01)

(52) U.S. Cl. ..... 366/112; 366/209

(58) Field of Classification Search ..... 366/111, 366/112, 128, 209, 213, 214
See application file for complete search history.

(56) References Cited

U.S. PATENT DOCUMENTS

| | | | | | |
|---|---|---|---|---|---|
| 681,254 | A | * | 8/1901 | Northway | 74/86 |
| 2,192,233 | A | * | 3/1940 | Mack | 451/74 |
| 3,310,292 | A | * | 3/1967 | Moore | 366/111 |
| 3,430,926 | A | * | 3/1969 | Liobis et al. | 366/212 |
| 4,109,319 | A | * | 8/1978 | Brandt | 366/219 |
| 4,628,729 | A | * | 12/1986 | Thoone | 73/178 R |
| 4,673,297 | A | * | 6/1987 | Siczek et al. | 366/208 |
| 4,750,845 | A | * | 6/1988 | Nabetani | 366/208 |
| 5,052,812 | A | * | 10/1991 | Tannenbaum et al. | 366/209 |
| 5,060,151 | A | * | 10/1991 | Mikyska et al. | 700/90 |
| 5,066,135 | A | * | 11/1991 | Meyer et al. | 366/208 |
| 5,184,893 | A | * | 2/1993 | Steele et al. | 366/209 |
| 5,268,620 | A | * | 12/1993 | Hellenberg | 318/114 |
| 5,346,303 | A | * | 9/1994 | Heinonen et al. | 366/208 |
| 5,372,425 | A | * | 12/1994 | Tannenbaum et al. | 366/208 |
| 5,464,773 | A | * | 11/1995 | Melendez et al. | 435/306.1 |
| 5,904,421 | A | * | 5/1999 | Mazzalveri | 366/213 |
| 6,579,002 | B1 | * | 6/2003 | Bartick et al. | 366/112 |
| 7,524,104 | B2 | * | 4/2009 | Malasky et al. | 366/208 |
| 7,547,516 | B2 | * | 6/2009 | Light, II | 435/6 |
| 2006/0187743 | A1 | * | 8/2006 | Carreras | 366/111 |
| 2007/0211566 | A1 | * | 9/2007 | Ebers et al. | 366/208 |

FOREIGN PATENT DOCUMENTS

| | | | | |
|---|---|---|---|---|
| DE | 19652152 | A1 | * | 6/1998 |
| JP | 2004255222 | A | * | 9/2004 |
| WO | WO 2005107931 | A1 | * | 11/2005 |

* cited by examiner

*Primary Examiner* — David Sorkin
(74) *Attorney, Agent, or Firm* — Volpe and Koenig, P.C.

(57) ABSTRACT

An orbital shaker which provides a shaking motion that is both stable and accurate to allow repeatability is provided, which allows for ease of cleaning of the shaking platform due to its mounting on a drive platform that keeps the entire drive system in an assembled state even if the shaking platform is removed for cleaning. A vibration sensor can also be provided that senses an unbalanced load on the orbital shaker and communicates with the orbital shaker controller to reduce the shaking speed in a pre-determined, trackable manner so that shaking of samples can be continued at a vibration level that is below a threshold value. Additionally, an incubating enclosure can also be provided in which a uniform heat is created throughout the entire incubating chamber in order to assure minimum temperature fluctuations between samples being processed regardless of their position on the shaking platform.

13 Claims, 9 Drawing Sheets

SECTION 4-4

INCUBATING ORBITAL SHAKER

CROSS-REFERENCE TO RELATED APPLICATIONS

This application claims the benefit of U.S. Provisional Application No. 60/842,698, filed Sep. 6, 2006, which is incorporated by reference herein as if fully set forth.

BACKGROUND

The present invention relates to an orbital shaker and in one particular aspect, to an incubating orbital shaker.

Orbital shakers are known for use in a laboratory environment to agitate an assay or test samples with a generally orbital motion. Certain orbital shakers also include a heated chamber in order to keep certain materials at a predetermined temperature during the agitation.

In the past, devices for achieving such orbital motion and heating have not provided sufficient stability and accuracy for the drive speed, which result in sample-to-sample differences that introduce additional error and uncertainty into production or test results. Additionally, for incubating orbital shakers, the incubation chambers in some known devices lack generally uniform heating resulting in test samples located in different areas of the shaking platform being heated at different temperatures. This also results in sample-to-sample variations that can be unacceptable in various types of testing.

In addition, some known orbital shakers do nothing to address unbalanced load conditions which can result in the samples being damaged and/or the orbital shaker itself walking off the edge of a laboratory table if unobserved. Additionally, in the event of spillage it is often difficult to clean the shaking platform, since it is typically directly mounted to the drive system and requires disassembly beyond that which should typically done by a user and/or can result in the drive system being unbalanced upon reassembly.

SUMMARY

The present invention provides an orbital shaker which provides a shaking motion that is both stable and accurate to allow repeatability. Additionally, it allows for ease of cleaning of the shaking platform.

In another aspect, the invention also includes is a vibration sensor that senses an unbalanced load on the orbital shaker and communicates with the orbital shaker controller to reduce the shaking speed in a pre-determined, trackable manner so that shaking of samples can be continued at a vibration level that is below a threshold value.

In another aspect of the invention, an incubating orbital shaker is provided in which a uniform heat is provided throughout the entire incubating chamber in order to assure minimum temperature fluctuations between samples being processed regardless of their position on the shaking platform.

BRIEF DESCRIPTION OF THE DRAWINGS

The foregoing summary, as well as the following detailed description of the preferred embodiment of the present invention, will be further understood when read in conjunction with the appended drawings. For the purpose of illustrating the invention, there is shown in the drawings an embodiment which is presently preferred. It is understood, however, that the invention is not limited to the precise arrangement and instrumentality shown. In the drawings.

DETAILED DESCRIPTION OF THE PREFERRED EMBODIMENTS

Figure 1:
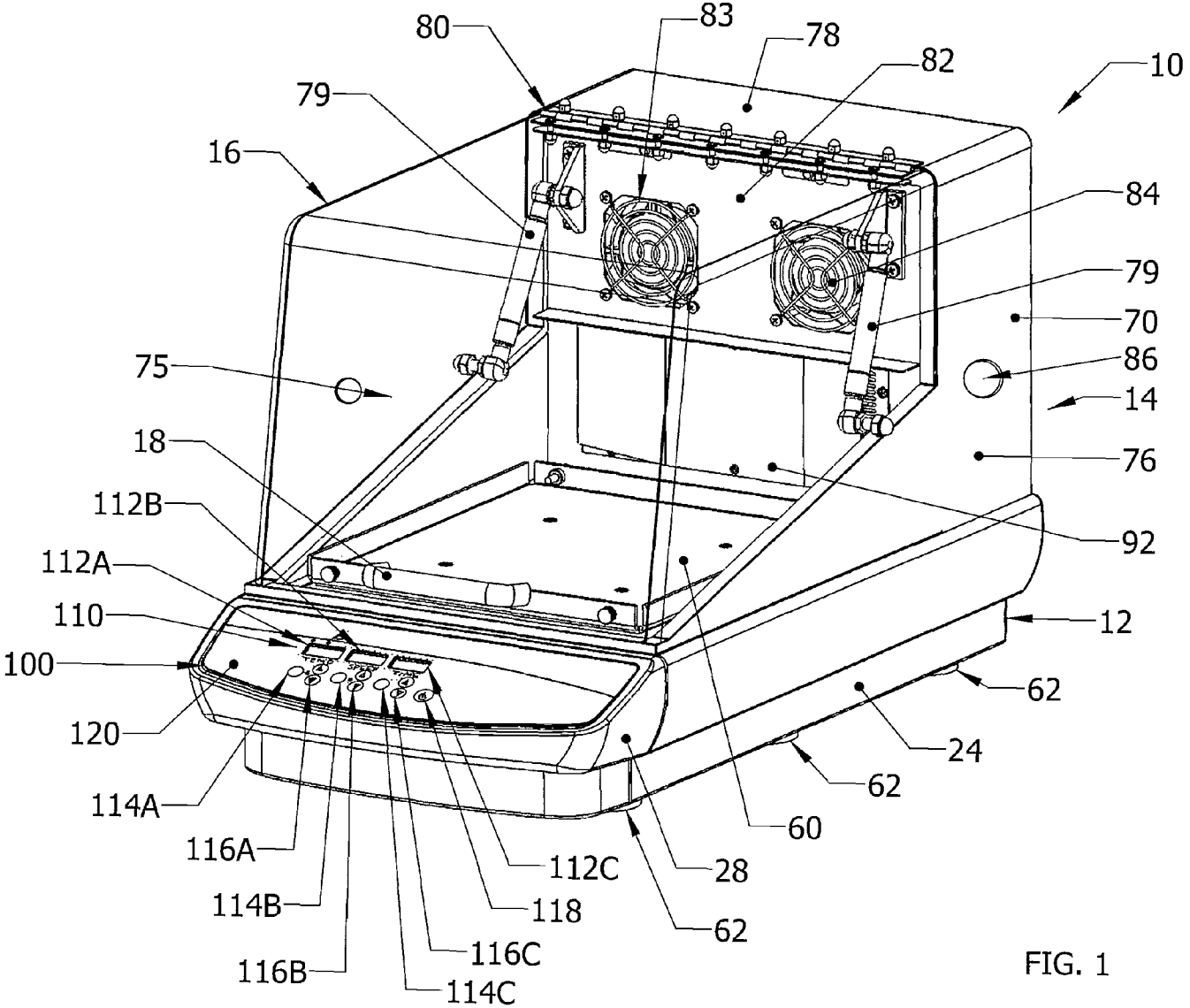
FIG. 1 is a perspective view of an incubating orbital shaker in accordance with a first preferred embodiment of the present invention.
Figure 2:
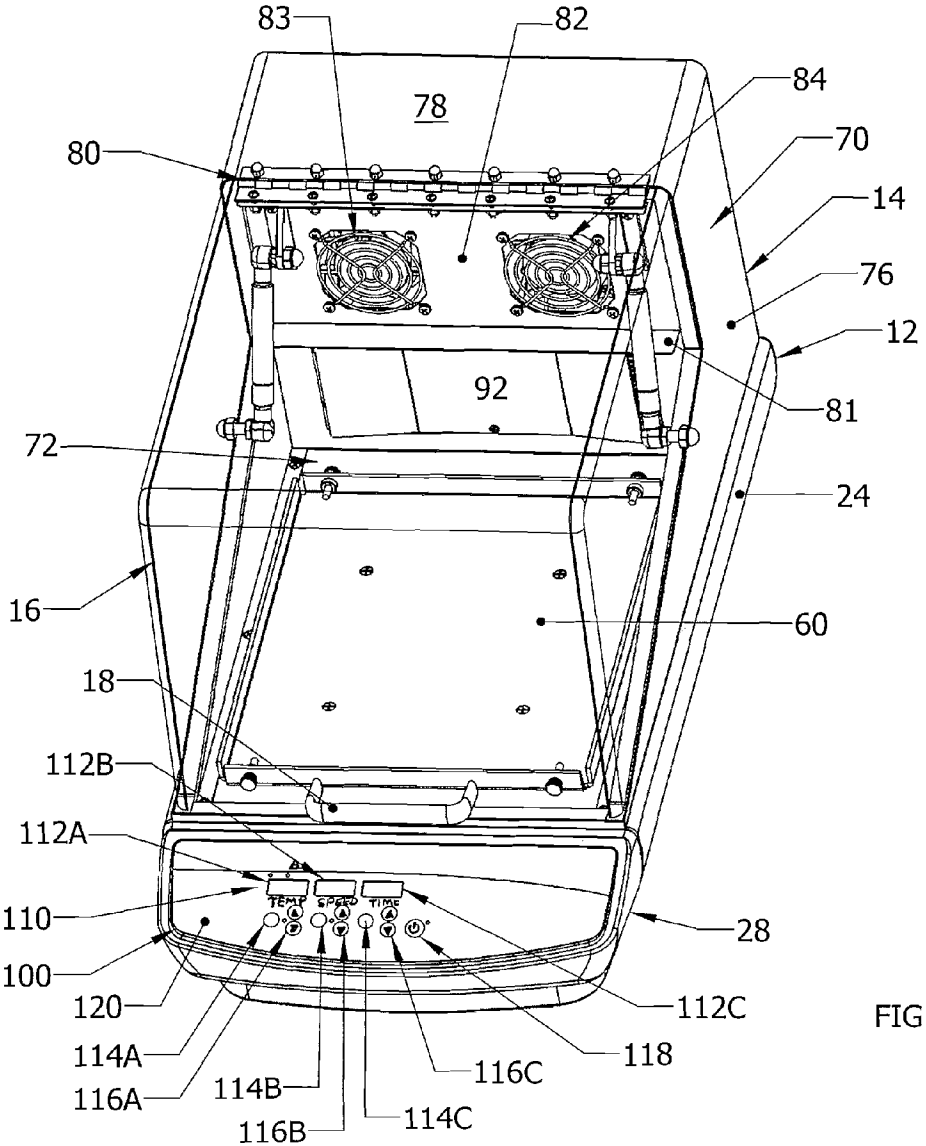
FIG. 2 is a top-front-right perspective view of the incubating orbital shaker of FIG. 1.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the incubating orbital shaker and designated parts thereof. The words "a" and "one" are defined as including one or more of the referenced item unless specifically stated otherwise. This terminology includes the words above specifically mentioned, derivatives thereof, and words of similar import.

Figure 4:
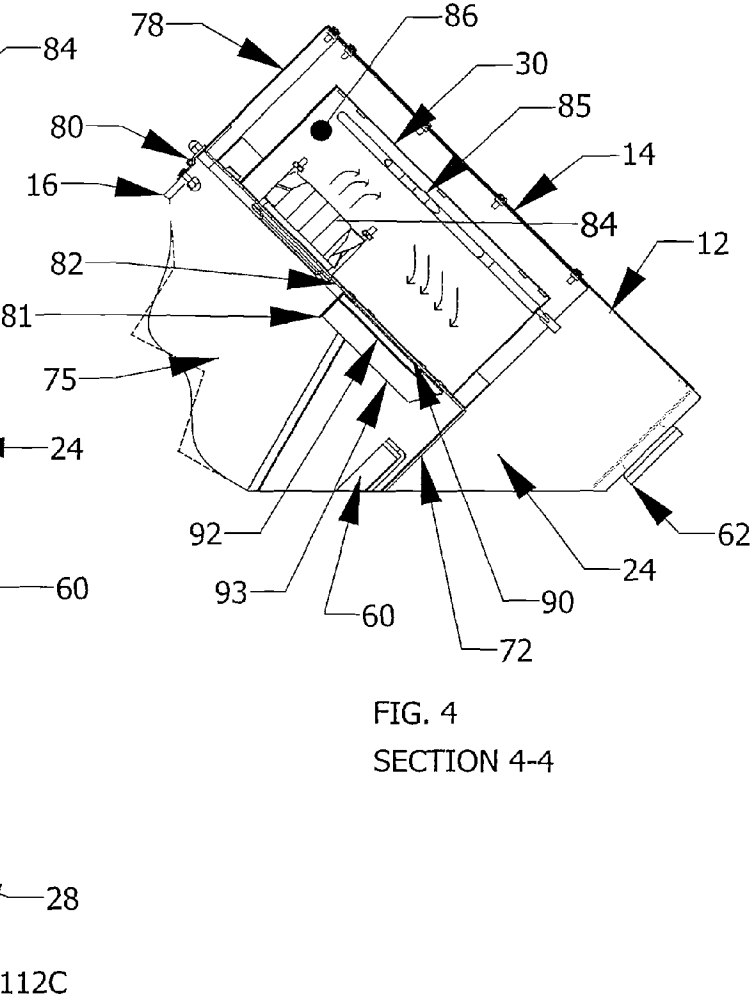
FIG. 4 is a partial cross-sectional view taken along lines 4-4 in FIG. 3.
Figure 5:
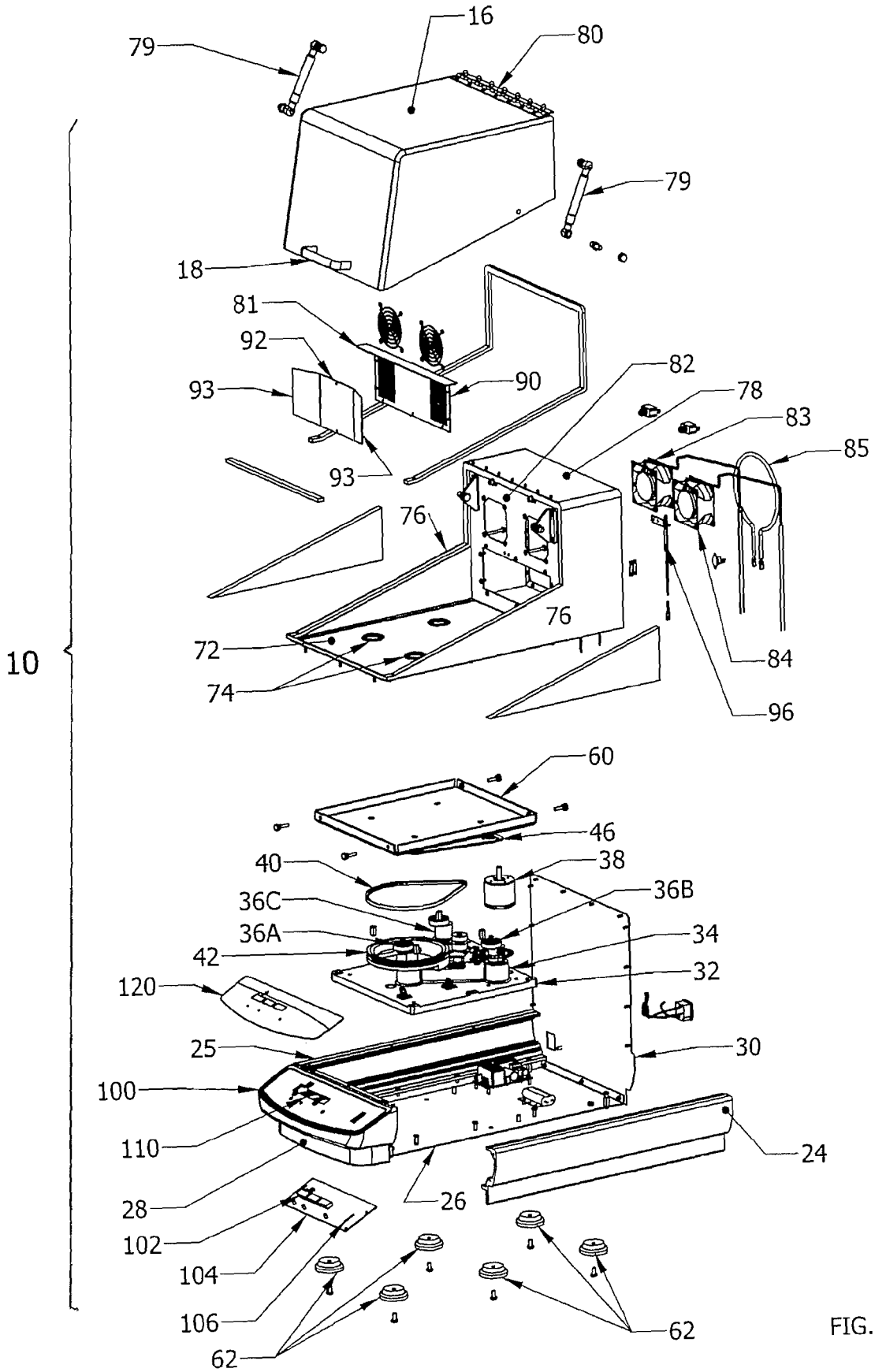
FIG. 5 is an exploded perspective view of the incubating orbital shaker of FIG. 1, showing all of the preferred components in accordance with the invention.

Referring now to FIGS. 1-5, an orbital shaker 10 in the form of an incubating orbital shaker in accordance with a preferred embodiment of the invention is shown. The orbital shaker 10 includes a base housing 12, in which the drive assembly 20 is mounted, as shown in FIG. 5, and an upper housing assembly 14, in which the incubating heater assembly 70 is provided. A pivoted cover 16 encloses the incubating chamber 75 in the upper housing assembly 14 over the shaking platform 60 where vials, test tubes, beakers and/or other containers holding test samples or other items to be shaken are placed. A control panel 100 is located at the front of the base housing 12 and is connected to a controller 102, shown in FIG. 5, which controls all of the shaker and incubating functions as well as receives user inputs and provides a connection for outputting data with respect to the shaking, speed and temperature performance of the shaker 10 as it is processing a test sample or other item.

As shown in FIGS. 1-5, and in particular in FIG. 5, the base housing assembly 12 can be formed of a plurality of pieces which are assembled via mechanical fasteners, adhesives or any other suitable means in order to form the base housing assembly 12. In a preferred embodiment, lower side panels 24, 25 are connected to a base panel 26. A front panel 28, which is preferably a molded plastic or a cast metal housing which includes the control panel 100 and holds the controller 102, is connected to the front of the lower side panels 24, 25 and base panel 26. A rear panel 30 is connected the back sides of the lower side panels 24, 25 and the base panel 26 and preferably also extends upwardly a sufficient distance to also provide the rear panel of the upper housing assembly 14.

The drive assembly 20, which is shown in detail in FIGS. 5-10, includes a base platform 32 with three preferably integrally formed support wells 34 for receiving eccentric bearing assemblies 36*a*-36*c*. A drive motor 38 is also mounted to the base platform 32 and includes a pulley 39 which drives a belt 40 that is connected to a weighted drive pulley 42, having an offset weight to counter vibration, connected to a first eccentric bearing assembly 36*a*. The eccentric bearing assemblies 36*a*-36*c* include a bearing with an off center post 44. The drive platform 46 is connected to the offset posts 44 of the eccentric bearing assemblies 36*a*-36*c* by bearings 48 located in bearing housings 49 that are connected to the drive platform 46 via fasteners 50. Fasteners 52 are used to secure the bearings 48 to the off center posts 44 of the eccentric bearing assemblies 36*a*-36*c*. The motor 38 drives the drive pulley 42 on the first eccentric bearing assembly 36*a*, which is connected to the other eccentric bearing assemblies 36*b*, 36*c* via the drive platform 46 to generate the shaking motion.

Figure 7:
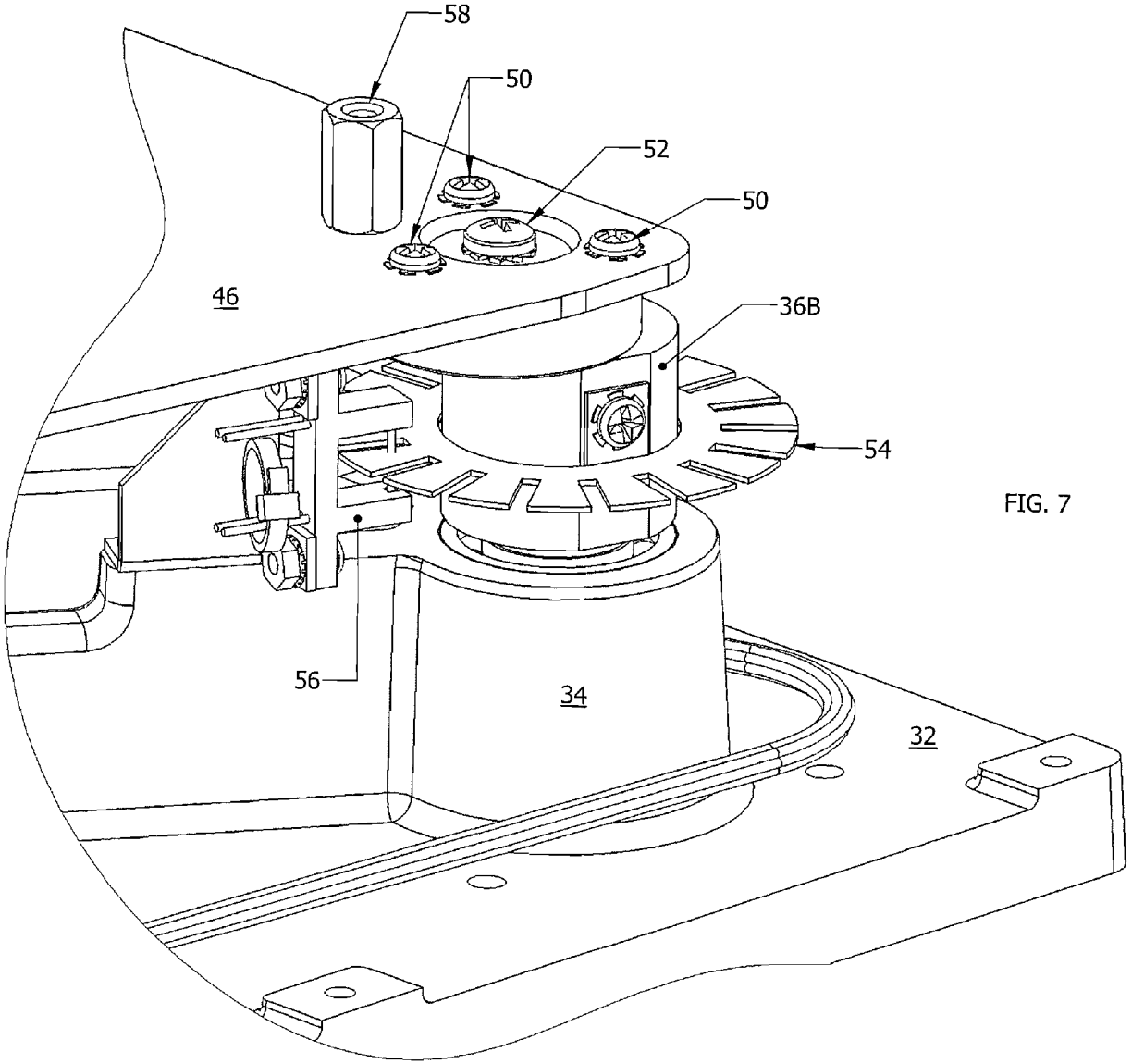
FIG. 7 is a greatly enlarged detail view, in perspective, of a sensor used to track the actual movements of the drive platform and shaking platform of the orbital shaker.
Figure 8:
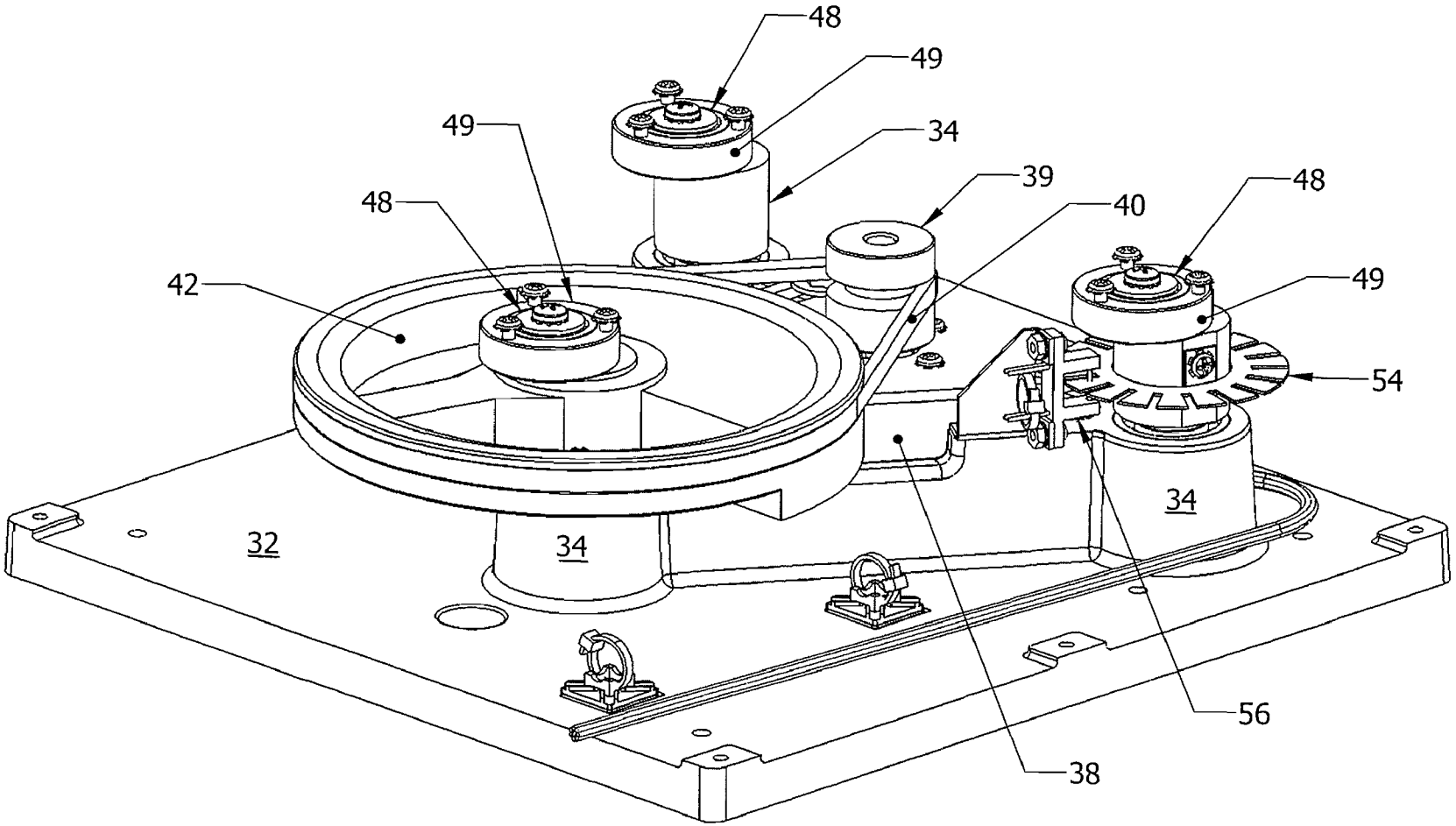
FIG. 8 is a perspective view similar to FIG. 6 in which the drive platform has been removed to show the motor and drive pulley as well as the oscillating drive platform mounts.
Figure 9:
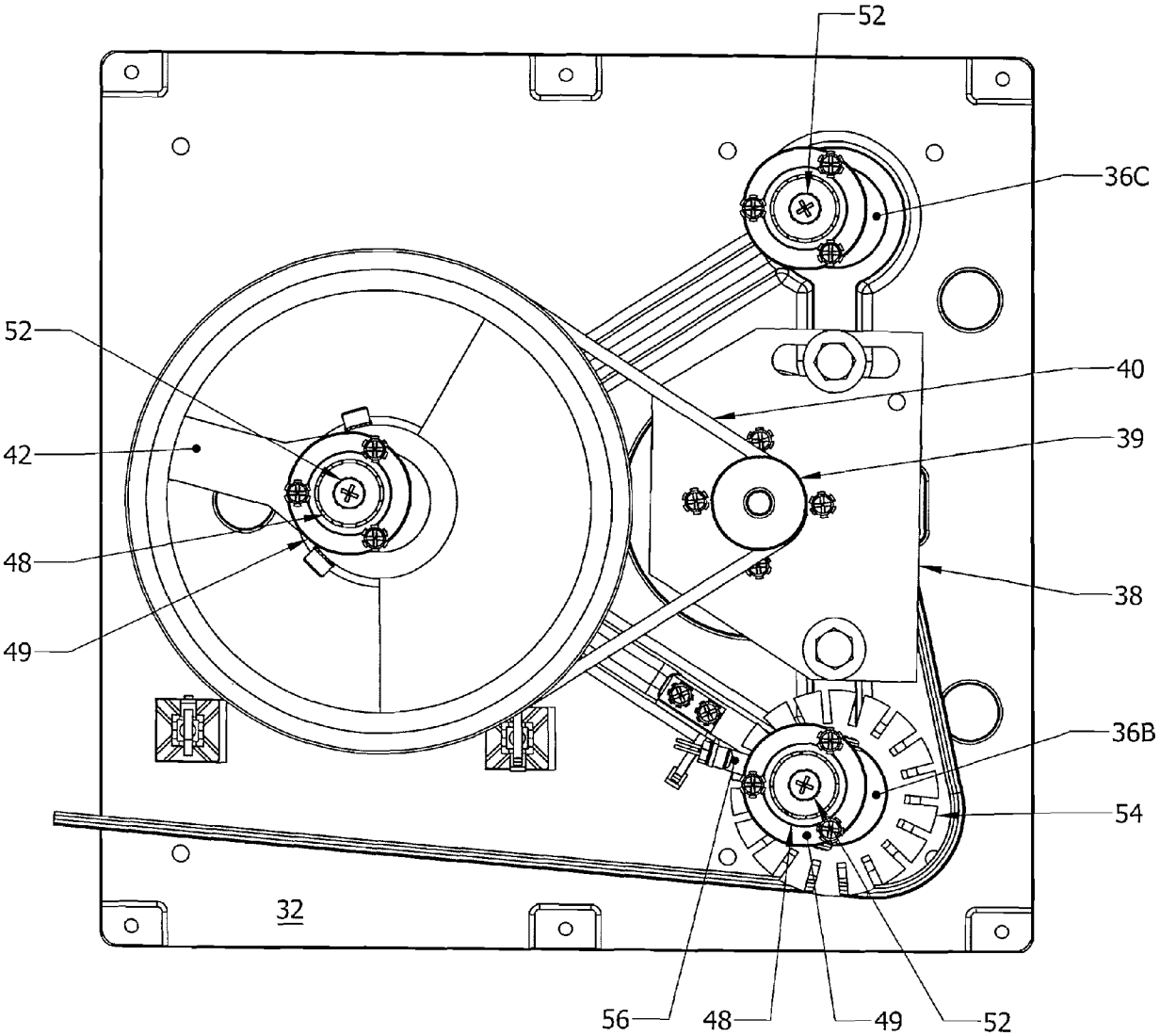
FIG. 9 is a top view of the arrangement shown in FIG. 8.
Figure 10:
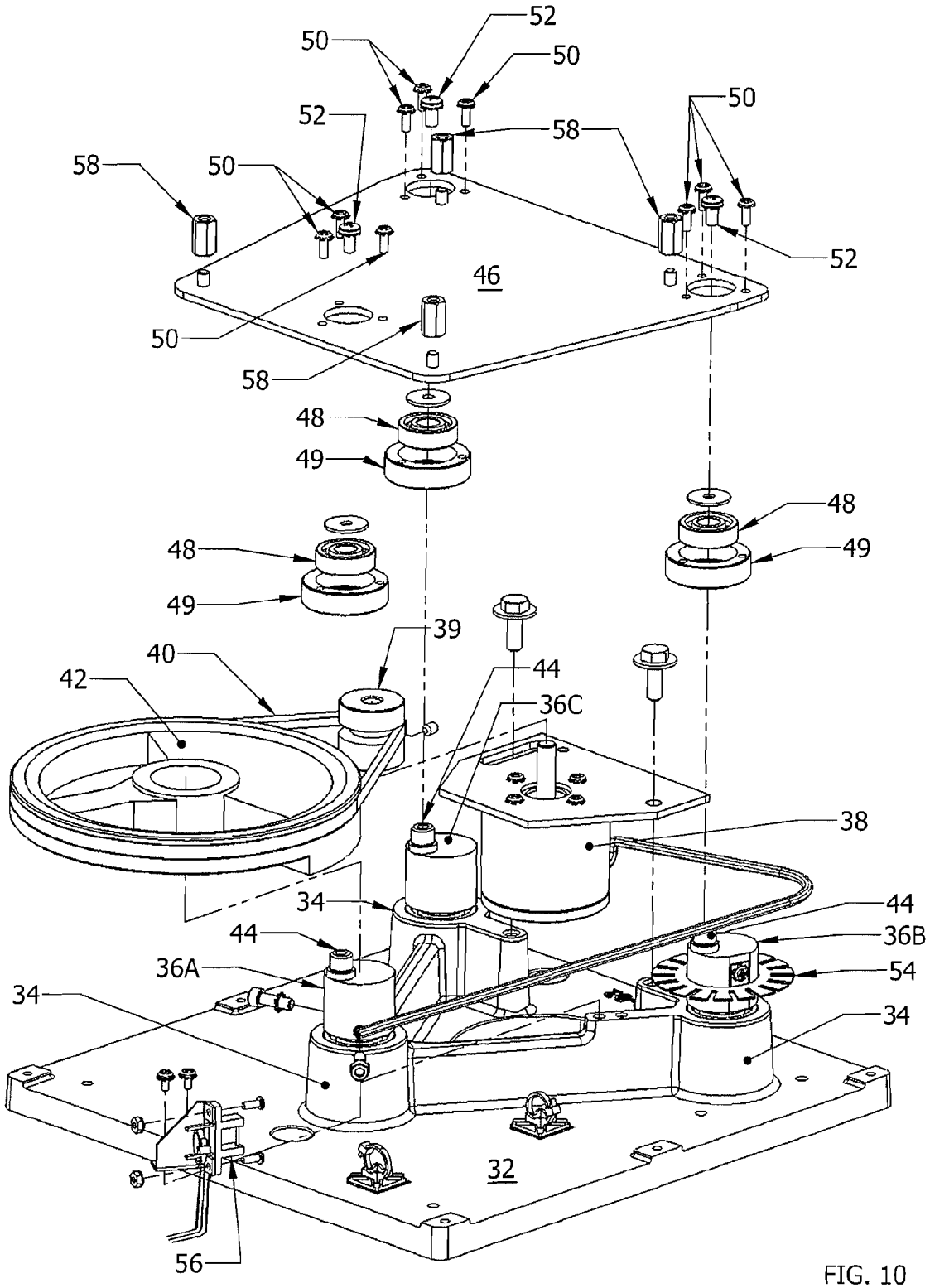
FIG. 10 is an enlarged exploded perspective view of the drive assembly shown in FIG. 6.

As shown in detail in FIG. 7, an encoder disc 54 is connected to the second eccentric bearing assembly 36*b*. An encoder sensor 56 is used to read the encoder disc 54 and transmits data regarding the actual movement of the drive platform to the controller 102.

The motor 38 is preferably a brushless DC motor with a Hall Effect sensor and therefore can be controlled to provide a desired speed. The encoder disc 54 and encoder sensor 56 preferably are a beam break optical sensor combination which detect the actual speed of the drive platform 46 rotations so that data on both the speed of the drive motor 38 and the actual movement of the drive platform 46 can be determined in order to account for slippage of the belt 40. In the preferred embodiment, the controller 102 can calculate the amount of belt slip, if any, and adjust the tray speed to be stable to plus or minus one rpm at speeds below 100 rpm and between plus or minus 1% of speeds between 101-500 rpm. This allows an extremely precise control of the shaker speed to be obtained according to the invention through the use of the two sensors in communication with the controller 102 to achieve the desired speed with both stability and accuracy. The controller 102 can also maintain the desired speed within the above-noted ranges throughout the entire cycle of a given test run therefore providing enhanced repeatability to the extent that multiple tests need to be run and compared with accuracy.

While the preferred motor 38 is a dc brushless motor, and the preferred sensor is an encoder disc 54 with an encoder sensor 56, those skilled in the art will recognize that other types of motors can be used and that other types of sensors can be employed to detect both the motor speed and actual speed of the drive platform 46 so that feedback adjustments can be made by the controller 102 to achieve the high stability and accuracy provided by the present invention.

Figure 6:
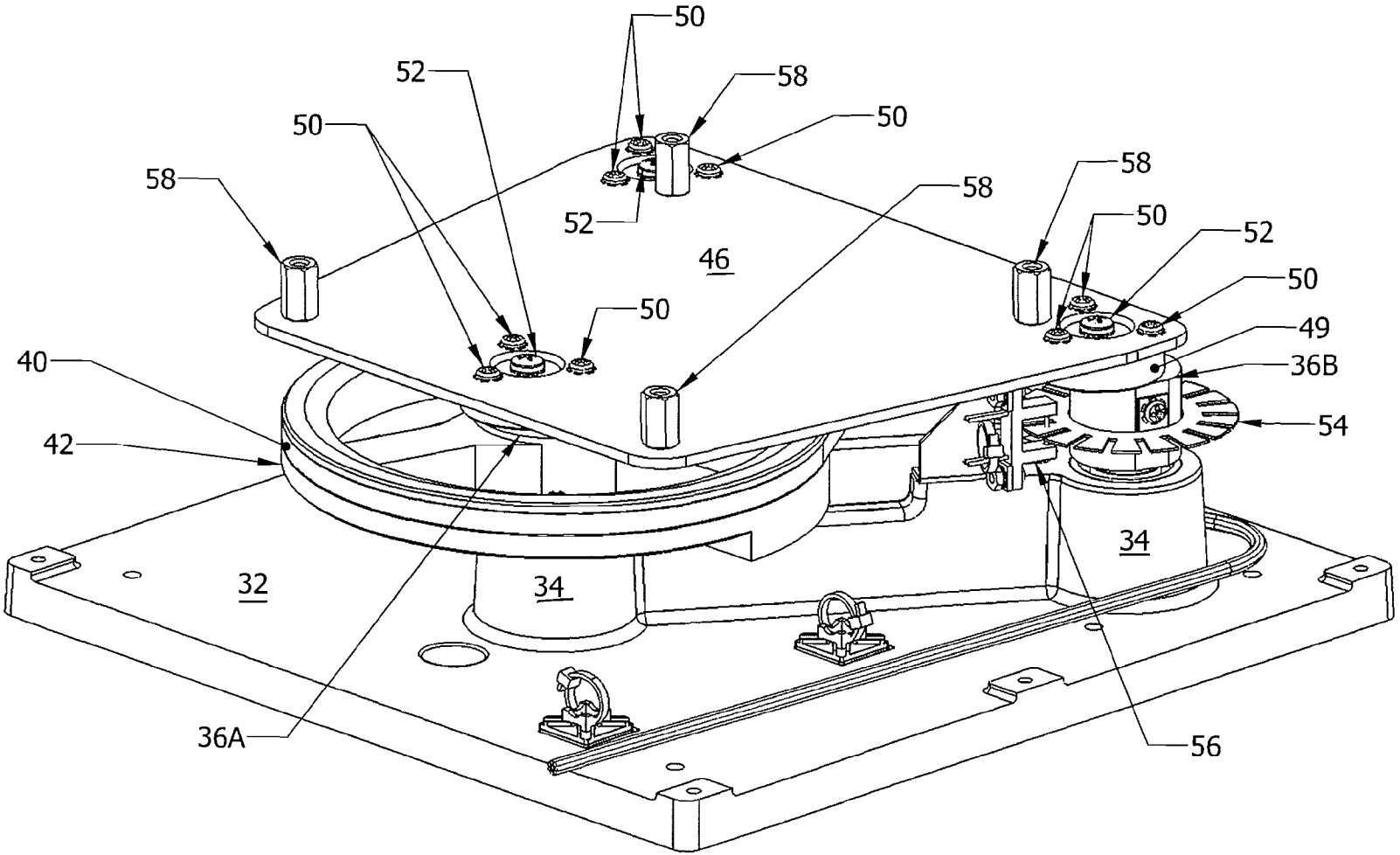
FIG. 6 is a perspective view of the drive mechanism and drive platform without the shaking platform installed.

Referring now to FIG. 6, stand-offs 58 are provided on the drive platform 46. The shaking platform 60 is mounted on the stand-offs 58, which preferably extend through openings 74 in the lower housing wall 72 of the upper housing assembly 14. The shaking platform 60 can therefore be easily removed, preferably by removing four fasteners, such as screws, which extend through the shaking platform 60 and into the stand-offs 58. This allows two further benefits of the incubating orbital shaker 10 according to the present invention in that the shaking platform 60 can be easily removed for cleaning without the need for disturbing the balance of the drive assembly 20. In the prior known shakers, the drive assembly is connected directly to the shaking platform and therefore if the shaking platform is removed it must be precisely reinstalled so that it is not out of balance and such that none of the eccentric bearing assemblies 36 are misaligned, which would result in an unstable movement as well as premature wear on the bearings to the extent that one may lead or lag the others in their movement. According to the present invention, the shaking platform 60 can be easily removed and the drive platform 46 maintains its connection with all three eccentric bearing assemblies 36*a*-36*c* ensuring that the precise alignment is maintained. Additionally, by allowing the user to easily remove the shaking platform 60, cleanup of spills can be easily performed in hard to reach areas, unlike the prior known shakers, without any effect on the performance of the equipment or requiring rebalance of the drive mechanism. This not only provides a savings in down time for cleaning spills but also eliminates unnecessary service calls or returns to the vendor for repair or rebalancing of a shaker drive assembly.

Preferably, the base platform 32 is made of iron or heavy material in order to provide stability to the shaker 10. However, those skilled in the art will recognize they can be made from various other suitable materials and appropriate weights can be added to the base housing assembly 12, if necessary.

Additionally, rubber feet 62 are preferably connected to the bottom of the base panel 26 to help absorb vibration and to maintain a more stable platform. While in the preferred embodiment the drive assembly 20 and the base housing assembly 12 are assembled using threaded fasteners, those skilled in the art will recognize that other suitable types of fasteners and/or adhesives can be utilized depending upon the particular assembly and maintenance requirements.

Referring again to FIGS. 1-5, the upper housing assembly with the incubator 70 is shown. The incubator 70 includes the lower housing wall 72 which is preferably formed from molded plastic or bent-up sheet metal that is able to resist temperatures of up to 65° C. Two side walls 76 extend upwardly from the lower housing wall 72 to the same height as the rear panel 30, and a top wall 78 closes a top portion of the heating chamber 86. The side walls 76 have angled portions which extend from a mid portion of the incubating orbital shaker 10 toward the front. Additional insulating panels 77, shown in FIG. 5, can also be attached as desired. The pivoting cover 16 is connected to a front edge of the top wall 78 via a hinge 80 and extends forward with a top wall, two side walls and a front wall in order to form an enclosure over the shaking platform 60 having a sufficient height to hold flasks, beakers and/or test tubes with samples that are being tested, defining the incubating chamber 75. A handle 18 is preferably provided on the front of the cover 16. As shown in FIG. 5, seals 17*a*, 17*b* can be provided around the periphery of the opening for the cover 16. Additionally, gas-spring holders 79 can be provided to hold the cover 16 in an open position.

A center wall 82 extends upwardly from the lower housing portion 72 to the front edge of the top wall 78 behind the shaking platform 60. This center wall 82 includes two spaced apart upper openings which receive fans 83, 84 that draw air from the incubating chamber 75 into the heating chamber 86 formed between the center wall 82, the rear panel 30, the back portions of the side walls 76 and the top wall 78. A heating coil 85 is located in the heating chamber 86 and heats the air drawn in by the fans 83, 84.

Figure 3:
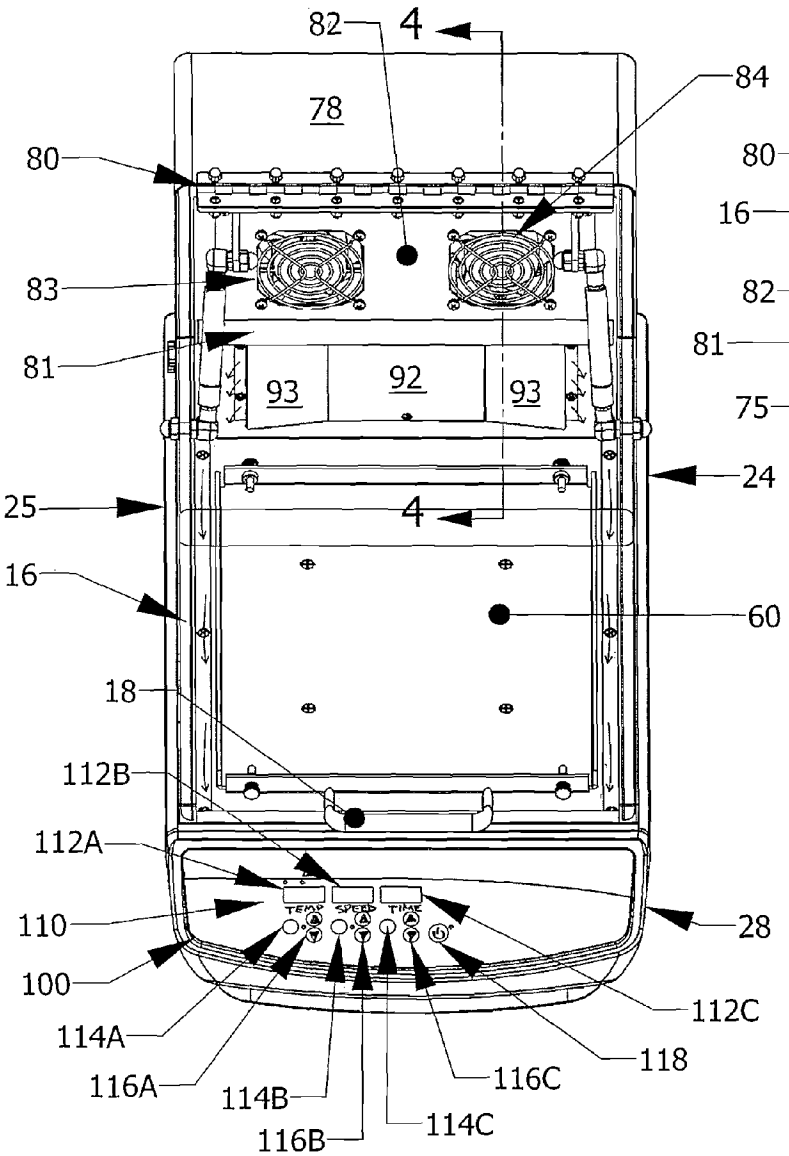
FIG. 3 is a top-front perspective view of the incubating orbital shaker of FIG. 1.

As shown in FIGS. 4 and 5, a lower opening 88 is provided in the center wall 82 which allows the heated air to return to the incubating chamber 75 over the shaking platform 60. A filter 90 is preferably located in the lower opening 88 and a baffle 92 is mounted in front of the opening and includes two bent side portions 93, 94 that direct the air flow sideways into the incubating chamber along the insides of the side wall 76 of the incubating chamber 75 and the side walls of the cover 16 as indicated by arrows in FIG. 3. A temperature sensor 96, shown in FIG. 5 is located in the incubating chamber 75 or the heating chamber 86 and provides a temperature signal to the controller 102. Additionally, preferably a horizontal baffle 81, shown in FIGS. 3-5, is located between the fans 83, 84 and the lower return opening 88.

Through the use of the fan arrangement which draws air from the incubating chamber 75 into the heating chamber 86 as well as the baffle 92 which directs the air flow out of the heating chamber 86 back into the incubating chamber 75 along the side walls of the incubating chamber 75, which rises upwardly due to heat convection, the present invention provides an extremely uniform heating throughout the entire incubating chamber and in particular through all areas on the shaking platform 60 so that uniform temperature can be achieved in all samples regardless of their position on the platform 60. This is extremely important for repeatability of testing and accuracy in test results. In comparison, the prior known incubating shakers provide fan driven airflow into the center of the incubating chamber resulting in higher temperature heating of samples located directly in the path of the heated air flow. Testing of the present invention has shown stability and accuracy in temperature control to less than 0.7° C. for samples located at any position on the shaking platform 60. In comparison, the prior known incubating shakers have temperature variations of plus or minus two degrees C. or more depending upon the location of the sample on the shaking platform. Thus, the present invention not only provides enhanced performance, but allows for higher accuracy testing of samples to be conducted.

Referring to FIG. 5, the controller 102 is preferably located in the base housing assembly 12 on a circuit board 104, and is preferably a PLC or another known type of programmable controller. A vibration sensor 106 is preferably also mounted on the circuit board 104 and provides a vibration signal to the controller 102. The controller 102 analyzes the frequency of vibrations to determine whether the vibration has risen above a threshold level where damage can occur to a sample and/or the shaker 10. When excessive vibrations are detected by the controller 102, the controller 102 generates an error signal and slows the shaking drive assembly 20 by lowering the motor speed to a lower rpm until the excessive vibration is no longer present. The unit 10 preferably notifies the user through the display panel 110 of the error. Preferably, the display panel 110 shows alternately that an error has been detected by showing the error code and alternately displays the actual speed of the shaking drive 20. An audible alarm can also be sounded. This data can also be transmitted by a serial port connection from the shaker 10 to allow the actual data log tracking to occur for the actual speed, time and/or temperature. While the vibration sensor may be of any suitable type, in a preferred embodiment, a ball-and-tube sensor which chatters open and closed as it is tilted or vibrated is used. One preferred sensor is a SQ-SEN-200 sensor from SignalQuest.

Referring to FIG. 1, the display panel 110 preferably includes digital LCD or LED displays 112*a*, 112*b*, 112*c* for temperature speed and time as well as on-off switches for each of these functions 114*a*-114*c*. Up-down buttons 116*a*-116*c* are also provided to control switches that adjust each of the functions for temperature, speed and time to desired values. An on-off button 118 is preferably provided for supplying power to the entire unit 10. These buttons/switches are all connected to the controller 102 so that the various functions can be set and controlled, allowing a user to set a desired temperature and speed for tests, as well as a desired test time allowing the incubating orbital shaker assembly 10 to carry out a pre-programmed test on samples loaded on to the shaking platform 60. Preferably, the control panel 100 is covered with a one piece spill-resistant cover 120 that allows the display 110 to show through and includes flexible portions over the buttons/switches so that in the event of any spill, nothing can enter through the cover 120 and into the switches and/or controller 102.

The controller 102 will preferably signal the display panel 110 to display the last set points on the displays 112*a*, 112*b*, 112*c* for the temperature speed and time, even when the unit is shut off or power is interrupted. The controller 102 preferably also includes or is connected to a built in audible alarm when the elapsed time has counted down to zero so that a user is informed that the testing cycle has ended and the unit automatically shuts off. Additionally, the controller 102 will shut down the unit and activate an audible and visual alarm if the temperature limit is exceeded to prevent damage to the unit 10.

In the preferred embodiment, the incubating orbital shaker can run in a speed range of 15 to 500 rpm. However, the range can be extended, as desired. Optional stands and covers may be provided for the shaking platform 60 in order to allow attachment of various different types of holders, such as test tube racks, clamps for flasks and/or beakers. Optionally, a non-skid rubber mat can be attached to or set on the shaking platform 60 that allows a petri dish or a cell culture flask to be set on the platform 60 and maintained in position.

Those skilled in the art will recognize that the present invention provides an improved orbital shaker with a high accuracy drive system which provides extremely accurate control with respect to both the stability and accuracy of the drive speed. This is adapted for use with any type of orbital shaker. Additionally, the vibration sensor according to the invention can also be used in any type of orbital shaker in order to provide for continued testing without damage to samples and equipment at safe speeds in the event that an unbalanced load condition occurs and it can also sound an alarm to alert a user who may not necessarily be closely monitoring the testing once it has begun.

Further, the invention provides a drive system which allows a user to remove the shaking platform 60 from any orbital shaker in accordance with the invention for cleaning of spills which may occur in use, without affecting the balance of the drive system which could then require outside repair, such as by a factory or dealer representative. In the case of an incubating orbital shaker, this also allows the incubating chamber to be cleaned to avoid contamination through residue of spilled materials which were not thoroughly cleaned from the chamber.

Additionally, in connection with the incubating orbital shaker of the preferred embodiment that incorporates the above features, it is also possible to provide an incubating orbital shaker with improved temperature control through the use of a fan/heating system with baffles which direct the airflow into the incubating chamber along the side walls along the lower portion of the incubating chamber 75 so that the heated airflow does not directly impinge upon samples. This results in a more uniform temperature throughout the entire incubating chamber regardless of the position of the samples on the shaking platform 60.

Those skilled in the art will recognize that one or all of the above-referenced features can be used alone and/or in various combinations to provide an improved orbital shaker or incubating orbital in accordance with the present invention.

What is claimed is:

1. An orbital shaker, comprising:

a drive assembly including a base platform;

at least three eccentric bearings mounted to the base platform with axes of the bearings being normal to the base platform, each of the eccentric bearings including an off-center posts, parallel to the axes of the bearings, that is connected via a respective mounting bearing to a drive platform;

a controller mounted in the orbital shaker a motor controlled by the controller and drivingly connected via a motor pulley and a belt to a drive pulley connected to a first of the at least three eccentric bearings, the motor including a motor speed sensor, the motor being adapted to generate an orbital motion of the drive platform by a movement path of the off-center posts of the eccentric bearings;

an actual speed sensor connected to a second of the at least three eccentric bearings, the motor speed sensor and the actual speed sensor generating speed signals that are transmitted to the controller, and the controller is adapted to compare the motor speed and actual speed sensor signals to calculate belt slippage and adjust a speed of the motor so that a desired actual speed is maintained;

a shaking platform removably connected to the drive platform;

a vibration sensor that detects a vibration level and transmits a vibration level signal to the controller, the controller is adapted to reduce a speed of the motor if a vibration threshold level is exceeded and transmit actual speed and time data for actual data log tracking.

2. The orbital shaker of claim 1, further comprising a memory that stores a preset motor speed of the motor.

3. The orbital shaker of claim 1, further comprising a user input to set the desired motor speed.

4. The orbital shaker of claim 1, wherein the drive pulley includes an offset weight to counter vibration.

5. The orbital shaker of claim 1, wherein the shaking platform is removable from the drive platform via separate fasteners from those connecting the drive platform and mounting bearings.

6. The orbital shaker of claim 1, wherein the actual speed sensor includes an encoder disk connected to the second eccentric bearing.

7. The orbital shaker of claim 1, further comprising:

an incubating assembly including a heating chamber and an incubating chamber with an openable cover, the incubating chamber having sides located around the shaking platform, and at least one fan located to move air from the incubating chamber into the heating chamber, a return opening located between the heating chamber and the incubating chamber in a lower section of the heating chamber to allow heated air to flow into the incubating chamber, and a baffle located at least partially in a path of the heated air flow through the return opening that directs return air along the sides of the incubating chamber.

8. The orbital shaker of claim 7, wherein the incubating chamber includes a lower wall that is connected to the sides, openings are located in the lower wall, and the shaking platform is located above the lower wall and connected to the drive platform via standoffs that extend through the openings.

9. The orbital shaker of claim 8, further comprising a control panel with user inputs located on the base platform, the user inputs including a temperature, a speed and a time, the user inputs being connected to the controller, and a display located on the control panel and connected to the controller to display the temperature, speed and time input by a user.

10. The orbital shaker of claim 9, wherein the controller stores a previous user input of the temperature, the speed and the time, and displays the previous user input after a power interruption.

11. The orbital shaker of claim 9, further comprising an audible alarm that is connected to the controller that is adapted to be actuated by the controller after a user input time has elapsed.

12. The orbital shaker of claim 9, further comprising an external data port connected to the controller for exporting temperature, speed and time data from the controller to an outside device.

13. The orbital shaker of claim 7, further comprising a filter located in the return opening.

* * * * *